United States Patent [19]

Allen et al.

[11] 3,980,856

[45] Sept. 14, 1976

[54] COUNTERBALANCE LINKAGE FOR A MICROWAVE OVEN DOOR

[75] Inventors: Kenneth D. Allen, Dayton, Ohio; Coy M. Tippy, New Iberia, La.

[73] Assignee: Hobart Corporation, Troy, Ohio

[22] Filed: Feb. 14, 1975

[21] Appl. No.: 549,921

[52] U.S. Cl. ..... 219/10.55 D; 49/254; 126/194; 312/323

[51] Int. Cl.[2] ..... H05B 9/06

[58] Field of Search ..... 219/10.55 D; 126/191, 126/194, 197, 198; 292/DIG. 7, DIG. 61, DIG. 69, DIG. 71; 312/323; 49/254–260

[56] References Cited

UNITED STATES PATENTS

| | | | |
|---|---|---|---|
| 3,157,176 | 11/1964 | Pearce et al. | 126/191 X |
| 3,343,904 | 9/1967 | Laug | 126/191 X |
| 3,748,423 | 7/1973 | Haagensen | 219/10.55 D |
| 3,756,219 | 9/1973 | Snyder et al. | 126/191 |

*Primary Examiner*—Arthur T. Grimley
*Attorney, Agent, or Firm*—Biebel, French & Nauman

[57] ABSTRACT

A microwave oven has an up-opening oven door which is hinged to be movable in an arcuate path. The door moves between a closed lower position covering an aperture to the cooking cavity in the front surface of the oven cabinet and an open upper position above the aperture. The axis of this arcuate motion is adjacent the upper edge of the oven door and internal to the oven cabinet. Connecting arms extend from pivots within the cabinet through openings in the front surface of the oven cabinet, and connect to the oven door. To counterbalance spring biased linkage is fastened to the connecting arms and acts to bias the door to its open upper position when the door is opened beyond a neutral point.

6 Claims, 5 Drawing Figures

COUNTERBALANCE LINKAGE FOR A MICROWAVE OVEN DOOR

BACKGROUND OF THE INVENTION

The present invention relates to a unique overcenter hinge arrangement to be used with a microwave oven having an up-opening door. In microwave heating appliances, the nature of the heating phenomenon is that of stressing certain of the molecules of the product to be heated by using an electromagnetic field, commonly in the heating frequency range of 2450 MHz. One of the more serious problems with such microwave oven devices has been concern about radiation leakage and the resulting possibility of operator injury. The primary area of such radiation leakage is the periphery of the oven door and for this reason a number of door designs have been developed to limit this leakage.

One type of seal used to suppress leakage of microwave radiation is a capacitive seal, such as shown in U.S. Pat. No. 3,808,391. The seal plate disclosed therein is a thin metallic plate which covers the oven cavity and presses firmly against the edges of the cavity. The surface of the plate has a thin coating of a suitable dielectric organosol. Surrounding the capacitive seal is a conductive sealing ring which acts as a secondary seal. It is important when using a capacitive seal arrangement that there be as great a capacitance between the door seal plate and the oven cabinet as possible. For this reason it is important that the seal plate and the cabinet be kept clean and that the dielectric organosol coating not be scratched. An oven such as shown in the above cited U.S. patent which is hinged along a side edge can make use of such a capacitive seal with little chance of the seal plate becoming damaged or soiled.

Where it is desired to provide an oven with a cooking cavity which is extended in width so as to be able to cook simultaneously more than one item, however, a door hinged at its side edge is impractical because, when opened, too much of the area in front of the oven will be obstracted. An oven having a wide cooking cavity therefore requires either an up-opening or a down-opening door. An up-opening door is preferred with such an oven for two reasons. First, counter space in front of the oven is available for use both when the oven door is closed and when it is opened. Second, the operator will not be tempted to place items on the capacitive seal plate when loading and unloading the oven, as he would be in the case of a down-opening door. Thus the likelihood of damaging or soiling the seal plate is minimized. With an up-opening door arrangement, however, it is necessary that a mechanism be provided to aid in opening the door and holding the door in its open position to allow loading of the oven.

SUMMARY OF THE INVENTION

In accordance with the present invention, a microwave oven is provided having an oven cabinet with an internal cooking cavity and an aperture in the front surface of the cabinet defining a plane. This aperture provides access to the cooking cavity. An oven door controls this aperture, having a closed lower position in which the door covers the aperture and an open upper position above the aperture in which the aperture is fully uncovered. A pivotal supporting means is connected to the door at its upper edge and extends through the front surface of the cabinet to a hinge point internal to the cabinet. The pivotal supporting means provides a point of attachment for a counterbalance mechanism which aids an operator in opening the oven door.

Accordingly it is an object of the present invention to provide a microwave oven having an up-opening door to which is attached a counterbalance mechanism which aids an operator in opening the oven door; to provide such an oven in which the counterbalance mechanism includes a spring under tension; and to provide such an oven in which the counterbalance mechanism will hold the door fully opened.

Other objects and advantages of the invention will be apparent from the following description, the accompanying drawings and the appended claims.

DESCRIPTION OF THE PREFERRED EMBODIMENTS

Figure 1:
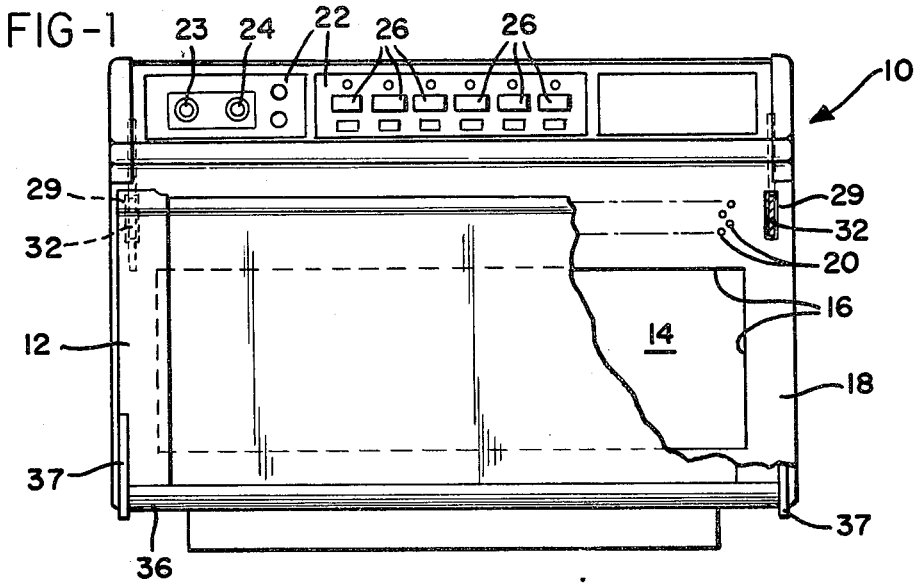
FIG. 1 is a front view of a microwave oven illustrating a preferred embodiment of the present invention with part of the door structure broken away.

Referring to FIG. 1, which illustrates a preferred embodiment of the invention, there is shown a microwave oven 10 having a door 12 which is partially broken away to reveal cooking cavity 14. An aperture 16 in the front surface 18 of the oven cabinet provides access to the cooking cavity. A number of vent holes 20 are provided in the front wall of the cabinet to permit gases to escape from the cavity 14 while food is being cooked. It is to be understood that these holes are of sufficiently small size that radiation leakage is prevented. The door extends across, but does not seal, the vent holes 20, and as seen in FIG. 1 the door covers essentially all the front of the cabinet except an upper control panel section. The control panel 22 is provided above the aperture to the cooking cavity. An ON switch 23 and an OFF switch 24 control the application of power to the control circuit and to a magnetron (not shown) which provides the microwave cooking energy to the cavity 14. A plurality of touch responsive switches 26 are used to set the cooking time period for oven operation. The touch responsive controls for the oven are disclosed and claimed in copending application, Ser. No. 549,922, filed on even date herewith and assigned to the assignee of the present invention. Two openings 29 in the front wall 18 of the oven cabinet permit pivotal supporting means 32 to be mounted behind the front wall and extend a connecting arm means through the front wall to attach to the oven door 12 near its upper edge.

A latch bar 36 extends between two plates 37 which are attached to a latching arrangement (not shown) internal to the door 12. This latch arrangement cooperates with strikes 40, shown in FIGS. 2 and 3, to provide a means for latching the door 12 in its closed position.

Figure 2:
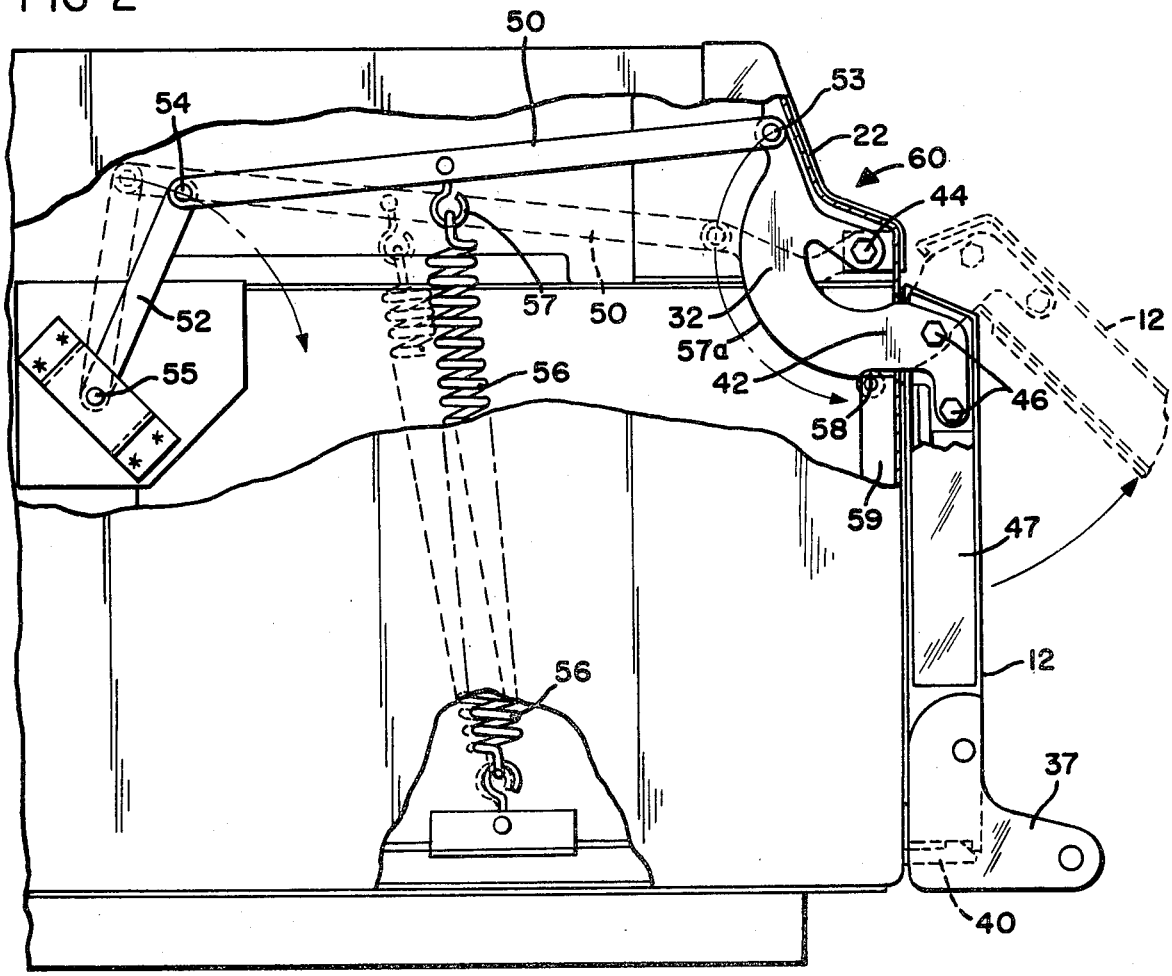
FIG. 2 is a side view of the oven with part of the door and oven cabinet broken away to reveal internal structure.
Figure 3:
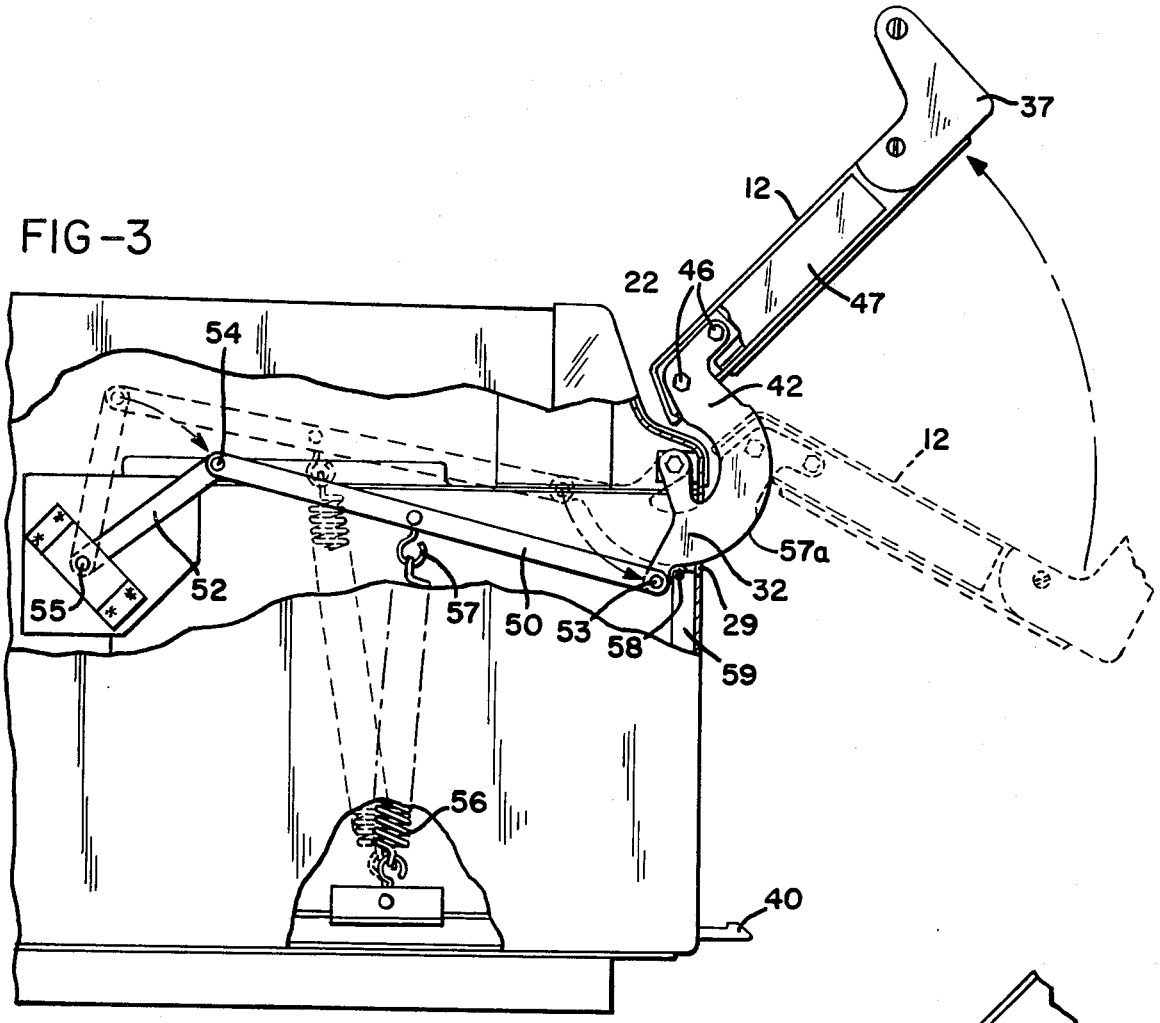
FIG. 3 is a view similar to FIG. 2 showing the door in its opened position.

The pivotal supporting means 32 including connecting arm means 42 is shown more clearly in FIGS. 2 and 3. The supporting means 32 is connected to the cabinet by stud 44 and pivots about this point. This hinge arrangement is disclosed and claimed in copending application, Ser. No. 549,965, assigned to the assignee of the present invention and filed on even date herewith. Connecting arm 42 is fixed to door 12 by two bolts 46 concealed by plate 47.

The pivotal supporting means 32 provides a convenient point of attachment for a counterbalance mechanism which includes a short link 52 and a longer, generally horizontally disposed link 50, pivot connections 53 and 54 between the links and arm means 42, fixed pivot 55, and spring means 56 which is anchored at one end to the cabinet and connected at its other end to a hook 57 on link 50. Pivot 53 provides a force receiving point for applying a door positioning torque to the connecting arm means 42. When the door is opened to a neutral position, approximated by the dashed line positions in FIGS. 2 and 3, the counterbalance mechanism aids in lifting the door 12 to its opened position, which is shown in FIG. 3. Characteristics of the counterbalance mechanism can be varied by changing the tension of spring 56 and the location of its point of attachment to the cabinet.

By such changes the mechanism may achieve an over-center action in which the door is urged towards its closed and open positions when on either side of a neutral position. The counterbalance mechanism may also be arranged to apply a torque which urges the door to its open upper position and which has a maximum value when the door is near a horizontal position and a value which decreases substantially as the door moves to other positions.

Pivotal supporting means 32 also includes a cam surface 57*a* upon which roller 58 rides. The roller 58 is connected to plunger 59 which in turn is connected to a safety interlock for the oven. The shape of cam surface 57*a* is such that when door 12 is opened, plunger 59 is depressed and the operation of the oven is prevented. The interlock arrangement is disclosed more fully and claimed in copending application, Ser. No. 549,964, filed on even date herewith and assigned to the assignee of the present application. As shown in FIG. 3, the roller 58 and cam surface 57*a* also act to limit the upward travel of the oven door when the door reaches its upper opened position.

Figure 4:
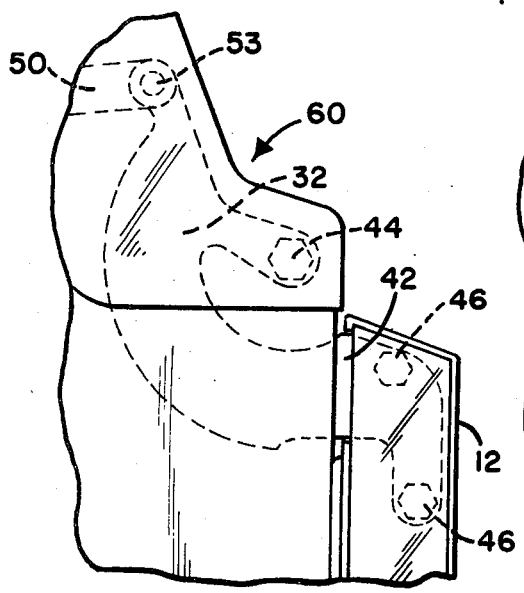
FIG. 4 is a partial side view of the oven with the door closed.

FIG. 4 is a partial side view of the oven cabinet and door illustrating the manner in which the pivotal supporting means 32 is concealed when the door 12 is closed. It should be noted that connecting arm means 42 is concealed when the door is closed except for a small portion which is visible from the side of the oven.

Figure 5:
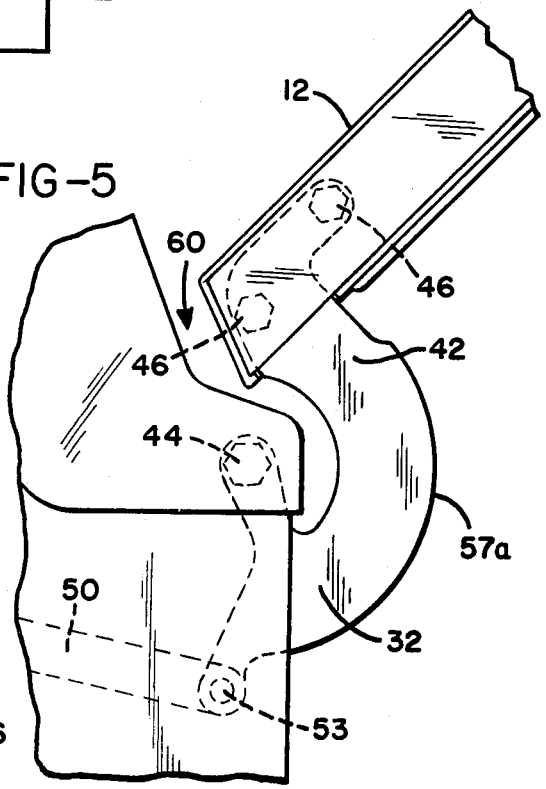
FIG. 5 is a partial side view of the oven with the door opened.

FIG. 5 shows how the recess 60 in the upper front surface of the oven cabinet, above the aperture 16, allows the door to travel in an arcuate path which is substantially greater than 90°. This wide opening angle permits easy access to the cooking cavity even when the oven is mounted at waist level. When completely opened the door shields the control panel so as to prevent accidental touching of the controls. It should be further noted that the hinge arrangement of the preferred embodiment moves the door outwardly from the front face of the cabinet so that cleaning the cabinet is facilitated.

While the form of apparatus herein described constitutes a preferred embodiment of the invention, it is to be understood that the invention is not limited to this precise form of apparatus, and that changes may be made therein without departing from the scope of the invention.

What is claimed is:

1. In a microwave oven which includes a cabinet defined by side, top, bottom, rear walls, and a front wall with a substantially vertically arranged aperture therein, said walls defining a heating cavity accessible through said aperture, and a source of microwave energy coupled to the interior of said cavity, the improvement comprising:

a cavity closing door movable in an arcuate path about an axis adjacent to the upper portion of said door from a closed lower position covering said aperture through an intermediate neutral position to an open upper position above said aperture, pivotal supporting means mounted behind said front wall and including connecting arm means extending through the plane of said front wall and rigidly connected to said door, and spring biased linkage means including a multiple link and spring mechanism located behind the plane of said front wall and attached to said connecting arm means, said linkage means being related to said pivotal supporting means such that said door is biased to its open upper position above said aperture when said door is raised beyond said intermediate neutral position.

2. The oven of claim 1 wherein said multiple link and spring mechanism includes a short link pivotally attached to said cabinet and a longer, generally horizontally disposed link pivotally attached to said short link and to said connecting arm means and further includes spring means disposed to urge said horizontal link in a direction having both horizontal and vertical components.

3. The oven of claim 1 wherein said link and spring mechanism includes a tension spring attached near the center of a generally horizontally disposed link.

4. In a microwave oven having a cabinet with a cooking cavity and an aperture in the front wall of said cabinet into said cavity and an oven door hinged near its top to said cabinet for movement from a closed lower position where said door is in sealing relation to said cabinet around said aperture through an intermediate neutral position to an open upper position in which said door is raised at least to the top of said aperture, the improvement comprising:

connecting arm means having one end fixed to said door, a short link positioned rearwardly of said door and having one end pivoted to said cabinet, a longer, generally horizontally disposed link pivotally connected to the other ends of said connecting arm means and said short link, and spring means connected between a fixed point on said cabinet and said horizontally disposed link, the spacing of said connecting arm means, said horizontally disposed link, said short link, and said fixed point being such that a rotation of said connecting arm means with said door as said door is opened beyond said neutral point causes said horizontally disposed link to apply a force to said connecting arm means which urges said door towards its open upper position.

5. A microwave oven having an upwardly opening door comprising:

an oven cabinet having an internal cooking cavity and an aperture in the front of said cabinet to said cooking cavity, an oven door, having a closed position in which said door covers said aperture and a fully opened position in which said opening is fully uncovered, pivotal supporting means connected to said door at the upper edge of said door and to said cabinet at a hinge point internal to said cabinet about which said door rotates, a generally horizontally disposed link pivotally connected at its front end to said pivotal supporting means, a short link, pivotally connected at a movable end to the rear end of said generally horizontally disposed link, and pivotally connected at a fixed end to said cabinet, and spring means, connected to said generally horizontally disposed link intermediate its said front and rear ends and to said cabinet in such a manner that an initial moving of said door from its said closed position will be substantially unopposed and further moving of said door towards its said fully opened position will be aided.

6. In a microwave oven which includes a cooking cavity formed by a cabinet having a front panel and further having an aperture in said front panel for access to said cavity and an upwardly opening door mounted to said cabinet on a pivot above said cavity, a counterbalance mechanism for said upwardly opening door comprising:

connecting arm means attached to the door and including a force receiving point rotatable through an arc about said pivot as the door travels from a closed lower position adjacent the front panel to an open upper position above the panel aperture; and means including a tension spring and mechanical linkage connected therewith and with said connecting arm means and said force receiving point for generating about said pivot point a door positioning torque, said torque having a maximum value when the door is near a horizontal position and a value which decreases substantially as the door moves to other positions.

* * * * *